US006767093B1

(12) United States Patent
Martin et al.

(10) Patent No.: US 6,767,093 B1
(45) Date of Patent: Jul. 27, 2004

(54) DOCUMENT PRINTING, STAGING, AND PRESENTATION DEVICE AND ASSOCIATED METHODS

(75) Inventors: Christian Martin, Miami, FL (US); Jon K. Holman, Lake Mary, FL (US); Dennis L. Steffen, Tavernier, FL (US); Leo D. Melnik, Melbourne, FL (US)

(73) Assignee: Kinetics, Inc., Lake Mary, FL (US)

( * ) Notice: Subject to any disclaimer, the term of this patent is extended or adjusted under 35 U.S.C. 154(b) by 71 days.

(21) Appl. No.: 10/213,360

(22) Filed: Aug. 6, 2002

Related U.S. Application Data

(60) Provisional application No. 60/310,328, filed on Aug. 6, 2001.

(51) Int. Cl.[7] ..... B41J 2/01

(52) U.S. Cl. ..... 347/107

(58) Field of Search ..... 347/107, 105, 347/14, 104, 5, 19–23, 37, 7, 8, 9, 17, 41, 4; 400/55, 56, 58; 318/280–286

(56) References Cited

U.S. PATENT DOCUMENTS

| | | | | |
|---|---|---|---|---|
| 4,272,771 A | | 6/1981 | Furukawa | |
| 4,398,461 A | | 8/1983 | Koike | |
| 4,712,929 A | | 12/1987 | Kitaoka | |
| 4,741,635 A | | 5/1988 | Shibata et al. | |
| 4,851,864 A | | 7/1989 | Fulton et al. | |
| 4,936,605 A | | 6/1990 | Kifer | |
| 4,958,171 A | | 9/1990 | Fulton et al. | |
| 4,962,393 A | | 10/1990 | Fulton et al. | |
| 4,980,704 A | | 12/1990 | Fulton et al. | |
| 4,996,539 A | | 2/1991 | Haraga et al. | |
| 5,012,261 A | | 4/1991 | Fulton et al. | |
| 5,012,434 A | | 4/1991 | Zietlow et al. | |
| 5,019,841 A | | 5/1991 | Fulton et al. | |
| 5,091,738 A | | 2/1992 | Fulton et al. | |
| 5,153,617 A | | 10/1992 | Salmon | |
| 5,235,676 A | | 8/1993 | Clay et al. | |
| 5,287,127 A | | 2/1994 | Salmon | |
| 5,576,744 A | * | 11/1996 | Niikura et al. | 347/14 |
| 5,617,122 A | * | 4/1997 | Numata et al. | 347/14 |
| 5,927,871 A | | 7/1999 | Nakata | |
| 5,971,632 A | | 10/1999 | LaDue et al. | |
| 6,109,745 A | | 8/2000 | Wen | |

* cited by examiner

*Primary Examiner*—Stephen D. Meier
*Assistant Examiner*—Charles Stewart, Jr.
(74) *Attorney, Agent, or Firm*—Allen, Dyer, Doppelt, Milbrath & Gilchrist, P.A.

(57) ABSTRACT

A passive, aerodynamic document printing, staging, and presentation system substantially reduces the time required to print and dispense multiple narrow-format documents, allows staging of multiple documents, and reduces document jamming without the use of active mechanical staging and presentation devices. The system includes a roll-feed wide-format printer, a paper chute for dispensing a printed document, an element for advancing a document from the printer to the paper chute, and an element for holding at least one document emerging from the paper chute.

21 Claims, 3 Drawing Sheets

DOCUMENT PRINTING, STAGING, AND PRESENTATION DEVICE AND ASSOCIATED METHODS

CROSS-REFERENCE TO RELATED APPLICATION

This application claims priority to provisional application 60/310,328, entitled "Document Printing, Staging, and Presentation Device," filed on Aug. 6, 2001.

BACKGROUND OF THE INVENTION

1. Field of the Invention

The present invention relates to document printers and, more particularly, to such printers having means for delivering and staging a document.

2. Description of Related Art

It is known in the art to print and output a document to a user such as a customer or customer service representative, such as those for printing receipts, airline tickets, and boarding passes.

An example of a previously used document staging and presentation device is exhibited in the ORCA self-service device, a product co-owned with the present invention. Some drawbacks of the ORCA device include a slow document print and dispense rate. In addition, the device requires a presenter and only allows single document staging. Also, because of the utilization of an active presenter and inconsistencies in the form of conventionally oriented narrow-format documents as they are dispensed, jams are more likely to occur.

The printer of Zietlow et al. (U.S. Pat. No. 5,012,434) enables a page to be printed in an arbitrary selected orientation. The label printer of Kitaoka (U.S. Pat. No. 4,712,929) also is adapted to print in variable formats to permit various label configurations. The ink jet printer of Furukawa (U.S. Pat. No. 4,272,771) includes a plural head that can print an entire line simultaneously. Koike (U.S. Pat. No. 4,398,461) discloses a small-size printer having a plurality of typing wheels. The print compressor of Shibata et al. (U.S. Pat No. 4,741,635) increases legibility of size-reduced symbols. Haraga et al. (U.S. Pat No. 4,996,539) teach a label printer that uses different memory cards for achieving desired printing formats. The printer of Salmon (U.S. Pat. Nos. 5,153,617 and 5,287,127) includes a toner source and delivery apparatus for printing with a programmable pixel intensity. Nakata (U.S. Pat. No. 5,927,871) discloses a printer having a scroll print buffer that is applicable independently of a structure of recording elements of a print head. The document printer of LaDue et al. (U.S. Pat. No. 5,971,632) is adapted to produce a variety of document formats from a host originated data stream. Wen (U.S. Pat. No. 6,109,745) teaches a printing apparatus for forming a borderless image on a receiver in response to a digital image file having a digital image and the desired size of the image to be formed.

SUMMARY OF THE INVENTION

It is an object of the present invention to provide a document dispenser having a rapid print and dispense rate.

It is another object to provide such a dispenser having multiple document staging.

It is an additional object to provide such a dispenser that minimizes a likelihood of jamming.

It is also an object to provide such a dispenser that does not require a mechanical presentation apparatus.

These objects and others are achieved by the present invention, a document printing, staging, and presentation device that substantially reduces the time required to print and dispense documents such as, but not limited to, narrow-format documents, allows staging of multiple documents, and reduces document jamming without the use of active mechanical staging and presentation devices.

A document staging and presentation device comprising an enclosure having a slot therein for retrieving a document therethrough and a printer housed within the enclosure. A spindle support is affixed within the enclosure, and a spindle is rotatably affixed to the spindle support The spindle is adapted to hold a roll of paper thereon and is positioned to feed an end of paper into the printer. The paper emerging from the roll has a curvature imparted by having been rolled.

A paper chute having an upper edge is positioned to receive a document exiting the printer and an aperture adjacent a lower edge. The paper chute has e downward slope that is adapted to permit the document to glide therealong aerodynamically, facilitated by the papers curvature, toward and through the aperture.

A staging tray is housed within the enclosure for receiving a document from the paper chute. The tray has a front edge adjacent the slot and a rear edge adjacent the paper chute aperture.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DESCRIPTION OF THE PREFERRED EMBODIMENTS

Figure 1:
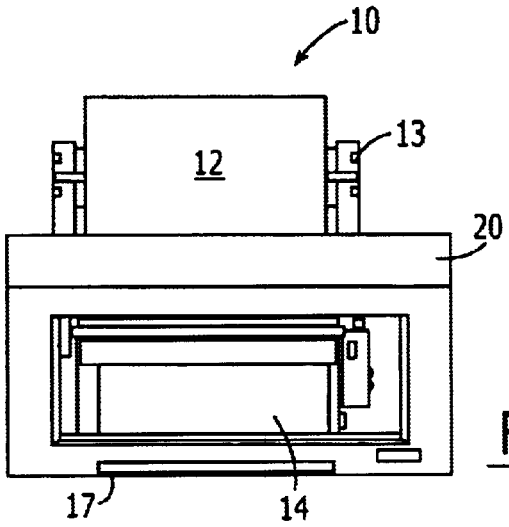
FIG. 1 is a front perspective view of the document printer, staging, and presentation device of the present invention.
Figure 2:
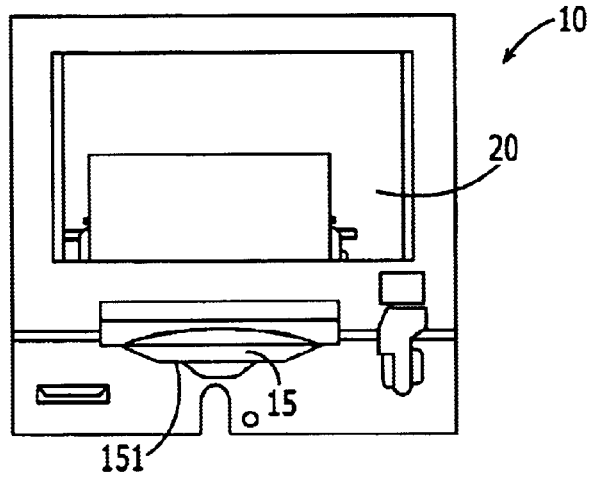
FIG. 2 is a top plan view of the device.
Figure 3:
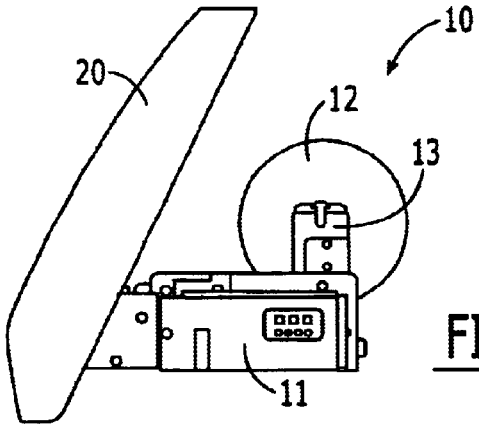
FIG. 3 is a side perspective view of the device in an open position.

The preferred embodiments of the present invention will now be discussed with reference to FIGS. 1–7.

The document printing, staging, and presentation device 10 of the present invention has as a particular feature a rotation of a printed document's orientation from other such devices known in the art so that a narrow-format document can be printed on a wide-format printer 11 by rotating the print orientation 90 degrees. Such an orientation is useful for applications in the airline industry to print and present receipts and boarding passes, although this is not intended as a limitation. In other applications it may be found desirable to use alternate print orientations depending upon the finished document characteristics.

A roll of paper 12 is rotatably held on a spindle 13 supported by a spindle support 131 in an enclosure 20. An end 121 of the paper 12 is threaded to engage the printing element of the printer 11. Thus the length of paper 12 that must transit the printer 11 is shorter than in prior art devices to produce a document 122 of similar overall size, enabling a more rapid printing of a document that has a width-to-length ratio greater than one.

Figure 4:
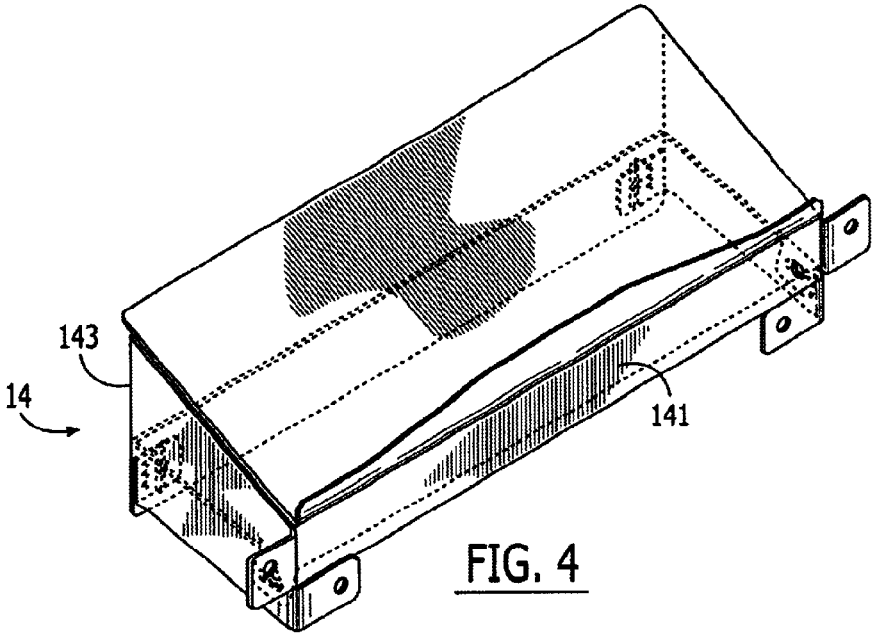
FIG. 4 is a side-top perspective view of the paper chute.
Figure 6:
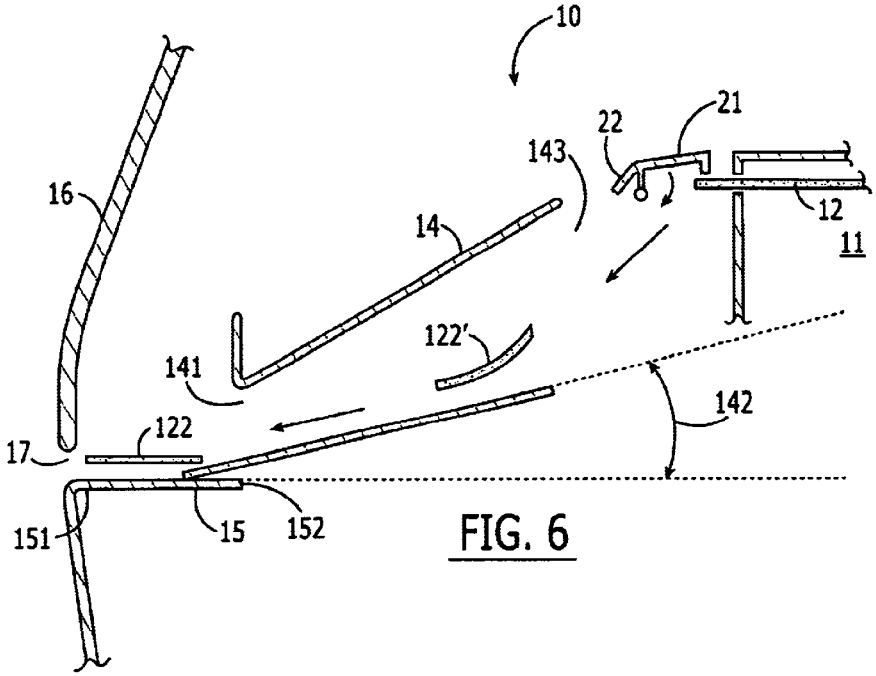
FIG. 6 is a side cross-sectional detail of the fascial presentation aligned with the paper chute and staging area.

Another feature of the device 10 is that the printer 11 is adapted to print an entire line simultaneously. This element substantially reduces the actual print time of each document 122. A completed document 122 then exits the printer 11 and is cut to a predetermined size using a rotating cutter 21. The cut document 122 then passes a set of static brushes 22 and free-falls downward and forward under the guidance of a paper chute 14 (FIGS. 4 and 6). The chute 14 has an entrance aperture 143 adjacent the cutter 21 and an exit aperture 141 through which the document passes. The chute 14 forms an angle 142 with the horizontal in a range of approximately 5 to 25 degrees, with a best mode embodiment for this application approximately 15 degrees, although this is not intended as a limitation. This range of angles 142 has been found useful in the particular embodiment of airline boarding pass and receipt printing, and permits a chute travel distance of up to 12 inches.

Figure 5:
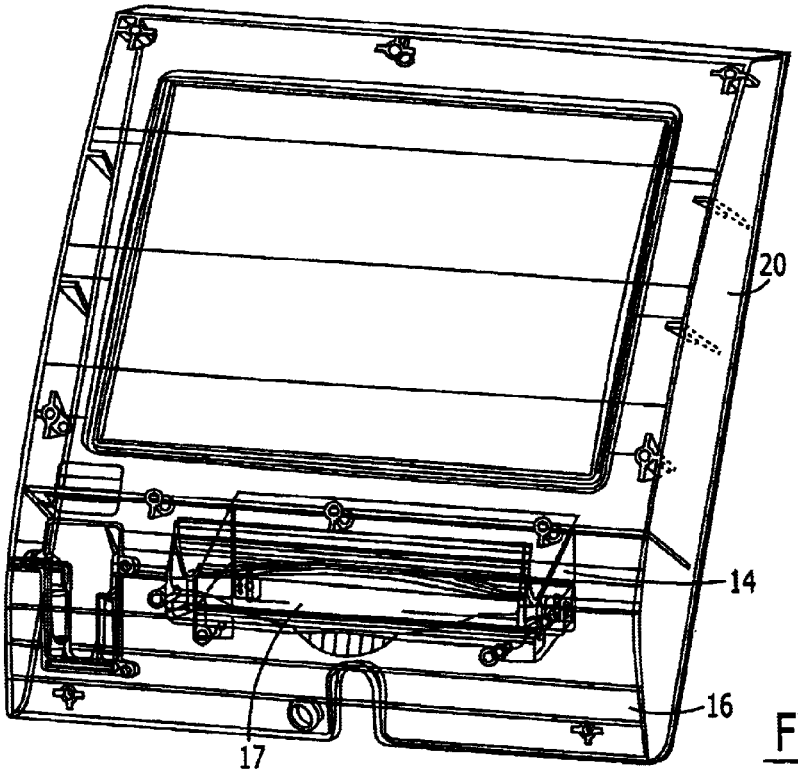
FIG. 5 is a top perspective view of the device.
Figure 7:
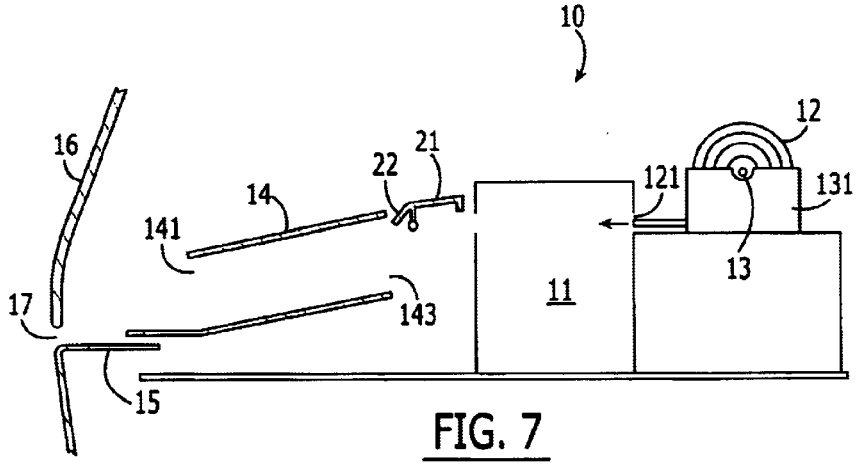
FIG. 7 is a side cross-sectional view of the device.

The document 122 is then staged in a staging tray 15 within the enclosure adjacent a fascia 16 slot 17 (FIGS. 5–7). The staging tray 15 is preferably housed within the enclosure 20 to provide added security and a smoother aspect to a user, thereby minimizing a risk to the user of snagging clothing or luggage on a protrusion and also minimizing a risk of damaging the device 10. The staging tray 15 has a front edge 151 adjacent the slot 17 and a rear edge 152 adjacent the chute aperture 141. The document 122 does not have to be removed from this staging tray 15 before another document 122' can be staged, providing the ability to stage a plurality of documents therein. It is to be noted that the documents 122 are not restrained by any mechanical device awaiting retrieval by a user, as in other devices known in the art, such as, for example, in automatic teller machines, which prevent multiple documents from being staged.

Preferably the slot 17 is dimensioned for improved security and user safety to be sufficiently large for permitting a human finger to pass therethrough and sufficiently small to prevent a human hand to pass therethrough. Thus a user can guide the staged document 122 out of the tray 15 using one or more fingers, without being able to access the moving mechanical elements of the device 10.

It has been shown that the orientation of the document 122 coupled with using the natural curl of the rolled stock 12 plus the aerodynamic effects produced by the interaction of this curl and the paper chute 14 and bezel result in the document gliding, in a controlled but rapid fashion, down to the staging tray 15 on a cushion of air. A byproduct of the improved orientation is a document 122 that is more rigid, improving stacking properties and further reducing the likelihood of document jamming. Another benefit is the use of fewer mechanical parts, which minimizes complexity and thereby potential for device failure.

It may be appreciated by one skilled in the art that additional embodiments may be contemplated, including alternate positioning of elements within the device.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A document staging and presentation device comprising:

an enclosure having a slot therein for retrieving a document therethrough;

a printer housed within the enclosure;

a spindle support affixed within the enclosure;

a spindle rotatably affixed to the spindle support, the spindle adapted to hold a roll of paper thereon and positioned to feed an end of paper into the printer, the paper having a curvature imparted by having been rolled;

a paper chute having an upper edge positioned to receive a document exiting the printer and an aperture adjacent a lower edge, the paper chute having a downward slope adapted to permit the document to glide therealong aerodynamically, facilitated by the curvature, toward and through the aperture; and a staging tray housed within the enclosure having a front edge adjacent the slot and a rear edge adjacent the paper chute aperture, for receiving a document from the paper chute.

2. The document staging and presentation device recited in claim 1, wherein the printer comprises a wide-format printer.

3. The document staging and presentation device recited in claim 2, wherein the printer is adapted to print a single line of printing substantially simultaneously.

4. The document staging and presentation device recited in claim 1, wherein the tray is adapted to hold a plurality of documents therein.

5. The document staging and presentation device recited in claim 1, wherein the slot is dimensioned sufficiently large for permitting a human finger to pass therethrough and sufficiently small to prevent a human hand to pass therethrough.

6. The document staging and presentation device recited in claim 1, further comprising means for cutting a printed document positioned between the printer and the paper chute.

7. The document staging and presentation device recited in claim 1, wherein the paper chute forms an angle with the horizontal in a range of approximately x to y degrees.

8. A document staging and presentation device comprising:

an enclosure;

a printer housed within the enclosure;

a spindle support affixed within the enclosure;

a spindle rotatably affixed to the spindle support, the spindle adapted to hold a roll of paper thereon and positioned to feed an end of paper into the printer, the paper having a curvature imparted by having been rolled; and a paper chute having an upper edge positioned to receive a document exiting the printer and an aperture adjacent a lower edge, the paper chute having a downward slope adapted to permit the document to glide therealong aerodynamically, facilitated by the curvature, toward and through the aperture.

9. The document staging and presentation device recited in claim 8, wherein the printer comprises a wide-format printer.

10. The document staging and presentation device recited in claim 9, wherein the printer is adapted to print a single line of printing substantially simultaneously.

11. The document staging and presentation device recited in claim 8, further comprising means for cutting a printed document positioned between the printer and the paper chute.

12. The document staging and presentation device recited in claim 8, wherein the paper chute forms an angle with the horizontal in a range of approximately x to y degrees.

13. A document staging and presentation device comprising:

an enclosure;

a spindle support affixed within the enclosure;

a spindle rotatably affixed to the spindle support, the spindle adapted to hold a roll of paper thereon, the paper having a curvature imparted by having been rolled;

a paper chute having an upper edge positioned to receive a piece of paper from the spindle and an aperture adjacent a lower edge, the paper chute having a downward slope adapted to permit the piece of paper to glide therealong aerodynamically, facilitated by the curvature, toward and through the aperture;

means for cutting a piece of paper from the roll of paper, the cutting means positioned between the spindle and the paper chute.

14. The document staging and presentation device recited in claim 13, wherein the paper chute forms an angle with the horizontal in a range of approximately x to y degrees.

15. A method for printing, staging, and presenting a document comprising the steps of:

feeding an end of a roll of paper into a printer;

printing a desired document;

cutting the document after the printing step to a desired size;

permitting the document to glide down a paper chute having an upper edge positioned to receive the cut document, the paper chute having a downward slope adapted to permit the document to glide therealong aerodynamically, facilitated by a curvature imparted by having been rolled; and staging and presenting the document exiting from a lower edge of the paper chute to a user.

16. The method recited in claim 15, wherein the printing step comprises using a wide-format printer.

17. The method recited in claim 16, wherein the printing step comprises printing a single line of the document substantially simultaneously.

18. The method recited in claim 15, wherein the staging and presenting step comprises stacking a plurality of documents.

19. The method recited in claim 15, wherein the staging and presenting step comprises permitting access to the document by a human finger and preventing access by a human hand.

20. The method recited in claim 15, wherein the paper chute forms an angle with the horizontal in a range of approximately x to y degrees.

21. A method for staging and presentation a document comprising the steps of:

supporting a roll of paper for rotation;

cutting a document from the paper roll to a desired size;

permitting the cut document to glide down a paper chute having an upper edge positioned to receive the cut document, the paper chute having a downward slope adapted to permit the document to glide therealong aerodynamically, facilitated by a curvature imparted by having been rolled; and staging and presenting the document exiting from a lower edge of the paper chute to a user.

* * * * *